United States Patent [19]

Levin et al.

[11] Patent Number: 4,903,416

[45] Date of Patent: Feb. 27, 1990

[54] HANDHELD CORDLESS HAIR DRYER

[76] Inventors: Mark R. Levin, 10032 Beacon Pond Ln., Burke, Va. 22015; William M. Nalley, 13601 Forest Dr., Silver Spring, Md. 20904; Dwight L. Green, 43 S. Rogers St., Hamilton, Va. 22068

[21] Appl. No.: 297,486

[22] Filed: Jan. 17, 1989

Related U.S. Application Data

[62] Division of Ser. No. 108,534, Oct. 15, 1987, Pat. No. 4,800,654.

[51] Int. Cl.[4] ..... A45D 2/00

[52] U.S. Cl. ..... 34/97; 126/401

[58] Field of Search ..... 34/97, 22, 96, 100, 34/101

[56] References Cited

U.S. PATENT DOCUMENTS 4,800,654 10/1987 Levin et al. ..... 34/97

*Primary Examiner*—Henry A. Bennet

*Attorney, Agent, or Firm*—Dennis H. Lambert

[57] ABSTRACT

A handheld cordless hair dryer utilizes a battery powered fan for directing a flow of air through a nozzle body portion within which a heat exchanger is disposed in heat exchange relationship with respect to both the airflow and heat generated by a gas combustion device. To provide a highly efficient transference of heat from the gas combustion device to the airflow, while avoiding high temperature conditions in exhaust gases discharged or at the peripheral wall of the nozzle body portion, the heat exchanger is comprised of a heat conductive inner duct and an outer duct between which conductive vanes extend, the outer duct being in spaced relationship with respect to an inner surface of the peripheral wall of the nozzle body portion and the inner duct serving as both a combustion tube and an exhaust duct for the gas combustion device. To provide a simple and safe operation, a single manually shiftable switch is actuatable in response to manually applied pressure exerted by the hand of a user grasping the handle body portion, the switch means being designed to automatically return to a deactivating position upon removal of the manually applied pressure, and a locking arrangement being provided to prevent inadvertent shifting of the switch into its activating position. Furthermore, a safety shutoff valve arrangement are provided for terminating the flow of gas to the gas combustion device when unsafe temperature levels result in the heat exchanger and whenever a flame is not produced or is extinguished after being produced.

10 Claims, 4 Drawing Sheets

HANDHELD CORDLESS HAIR DRYER

This is a division of application Ser. No. 108,534, filed Oct. 15, 1987, now U.S. Pat. No. 4,800,654.

BACKGROUND OF THE INVENTION

1. Field of the Invention

The present invention relates to hair drying apparatus of the type that are designed to be hand held, and which produce a flow of hot air without requiring the dryer to be connected to an external A/C power source to operate. In particular, the present invention is directed to improvements in such handheld cordless hair dryers which will serve to make a hair dryer produced in accordance with the invention lighter, safer, more compact, and more convenient to use than previously existing hair dryers of this type.

2. Description of Related Art

The overwhelming majority of handheld hair dryers in use today are of the type which must be connected to an external A/C power source via an electrical connector cord. The electrical power derived from the A/C power source is used to heat electrical heating coils, across which a flow of air is directed by a blower. Because such hair dryers have a power requirement of as much as 600 to 1200 watts, they are not suitably adaptable to "cordless" usage because it is not feasible to meet this power requirement via a D.C. power supply (such as storage batteries) in a device intended to be held comfortably in one hand.

Therefore, to obtain a handheld hair dryer that does not have its portability tied to the length of its electrical power cord, handheld hair dryers have been developed which use a gas or liquid fueled combustion device to heat the flow of drying air. One example of a cordless handheld hot air hair dryer of this type is that of Bourdeau U.S. Pat. No. 4,635,382. The dryer of the Bourdeau patent is provided with a fuel reservoir for storing a vaporizable fuel in a liquid state and the fuel is vaporized and combusted within a heating chamber disposed in a nozzle portion of the dryer. The heating air flow is generated by a battery powered motor that is used to drive the fan, and a single manually operated control means is used to control both the amount of current applied to the fan motor and to adjust the flow of fuel to the combustion device. This manually operated control means utilizes a slide-type actuator to move a rheostat for the fan motor and a valve of a fuel supply line.

However, the hair dryer of the above-noted patent provides no means for preventing the combustion fumes from being mixed with and discharged along with the heating air, nor are there any safeguards to protect against overheating conditions or failure of the combustion device to ignite. Likewise, the fact that the dryer contains a reservoir of liquid fuel poses a significant safety hazard, as does the fact that, once the actuating member of the manually operative control means is shifted into its "on" position, it remains in its operational state, even if the user should not be holding the device at the time, having put it down without turning it off. Finally, the heater of the device employs asbestos which is hazardous, and the unit incorporates a recharging transformer in the handle which both adds weight to the unit as well as placing an electrical component close to the reservoir of ignitable fluid.

Another patent disclosing a cordless handheld hair drying apparatus is that of the Raccah, et al. U.S. Pat. No. 4,555,232. The Raccah, et al. patent discloses several different dryer constructions. In accordance with aspects of each of these embodiments, various of the above-noted deficiencies are overcome. For example, in one embodiment, instead of utilizing a liquid fuel reservoir, a gas-containing fuel cartridge is placed within the handle portion of the dryer. Additionally, a flame detector is provided to shut off the gas supply in the event of a flame failure and a temperature sensing means is provided in another embodiment whereby a valve progressively closes as the temperature in the vicinity of the burner increases, thereby decreasing the supply of fuel to the burner and acting to prevent a temperature overload. Furthermore, while this patent discloses that steps may be taken to prevent combustion products from entering the air flow, via ducts or shrouds, no particular arrangement for achieving such a result is described. Still further, all of the embodiments disclosed in the Raccah, et al. patent are relatively complex in construction and they fail to provide an arrangement whereby heat output can be maximized without overheating the nozzle body portion of the dryer.

Thus, there is still a need for a compact, cordless handheld hair dryer which can be produced in a simple and, therefore, less costly manner, yet still maximizes safety and heat output efficiency.

SUMMARY OF THE INVENTION

In view of the foregoing, it is an object of the present invention to provide a compact, cordless hair dryer which will overcome the above-noted deficiencies of the prior art by being simple to construct and easy to use, while being a safe and highly efficient heat producing device.

It is a particular object of the present invention to provide a handheld cordless hair dryer wherein maximum heat can be transferred from a burner to an airflow via the use of a heat exchanger comprised of inner and outer ducts having heat conductive vanes extending along and between the ducts, wherein a combustion device is mounted in one end of the inner duct and an opposite end of the inner duct opens exteriorly through a peripheral wall of the nozzle body portion so that the inner duct comprises a combustion tube and exhaust duct for the gas combustion device, and air may be circulated through the space between the inner and outer ducts in a highly effective heat transfer relationship with respect to the combustion flame and exhaust within the inner duct, yet the heat exchanger can be thermally shielded relative to the peripheral wall of the nozzle body itself.

Yet another object in accordance with the present invention is to provide safety shutoff means which will terminate the flow of gas to the combustion device whenever temperature levels in the heat exchanger exceed a predetermined safety limit and whenever a flame is not present after triggering of the igniter of the combustion device.

Another object of the present invention is to provide a manually operable actuation means for activating the gas fuel supply for the combustion device of the inventive dryer that comprises a single manually shiftable switch means which may be operated by a simple depression of a push-button by a finger of a user's hand grasping a handle body portion of the dryer, so as to commence a flow of gas to the combustion device followed by triggering of the ignition means therefor and activating of fan means for the heating airflow, which will automatically return to a released deactivating position when manually applied pressure is removed therefrom, and wherein lock means is provided to prevent inadvertent shifting of the switch means into an operative position.

The above objects and others are achieved in accordance with a preferred embodiment of the present invention by providing the dryer with a handholdable body having a handle body portion and a nozzle body portion mounted to a top end of the handle body portion. Battery powered fan means are provided for drawing a flow of air into the nozzle body portion and for directing the flow of air along a path through the nozzle body portion and out of a discharge opening located in an outlet end of the nozzle body portion. This battery powered fan means can be conveniently mounted at an opposite end of the nozzle body portion circumferentially flanked in part by a rechargeable D.C. power supply. A heat exchanger is disposed in the path of air directed through the nozzle body portion and a gas combustion device is disposed in the nozzle body portion in heat exchange relationship with the airflow produced by the fan means via the heat exchanger.

A supply of gas fuel is provided via a self-contained supply of gas received in a gas container receiving space in the handle body portion. Also located in the handle body portion is a manually operable actuation means for activating a supply of the gas fuel to the gas combustion device for igniting of the gas combustion device via an ignition means, and for turning on of the fan means.

In accordance with a significant aspect of the present invention, a highly efficient transference of heat from the combustion device to the airflow is produced by designing the heat exchanger of a heat conductive inner duct, an outer duct, and heat conductive vanes extending along and between the inner and outer ducts in heat exchange relationship to the airflow, and by having the inner duct serve as both a combustion tube and an exhaust duct for the gas combustion device. The gas combustion device is located at one end of the inner duct and the other end opens exteriorly through a peripheral wall of the nozzle body portion. This construction is particularly effective when the combustion device is located at the outlet end of the heat exchanger and the exhaust outlet end of the inner duct is disposed in proximity to the inlet end of the heat exchanger. This construction also offers the benefits of preventing combustion products from entering into the heating airflow and by providing a space between the inner surface of the peripheral wall of the nozzle body portion and the outer duct which can be used to shield the peripheral wall from the high temperatures existing within the heat exchanger.

In accordance with another aspect of the present invention, a simple and compact construction for enabling a single manually shiftable switch means to be operated by a hand of a user grasping the handle body portion is provided for commencing a flow of gas to the gas combustion device followed by triggering of the ignition means and activating of the fan means in a manner which provides a high degree of safety. In particular, the switch means is caused to automatically return to its released position deactivating the apparatus upon removal of manually applied pressure therefrom. Advantageously, the manually shiftable switch means is a push-button actuator mounted for radial reciprocation within the handle body portion and the means for automatically returning the manually shiftable switch means to its released position is a spring acting between the push-button actuator and an inner wall of the handle body portion.

Furthermore, the compactness of the arrangement is facilitated by disposing this switch means between a first reciprocable operator for controlling the flow of gas and a second reciprocable operator for controlling triggering of the ignition means and activating of the fan means. In this manner, a cam and follower relationship can be established between the push-button actuator and the operators so that the operators can be displaced in a controlled sequence in opposite directions, as the push-button is pressed, such as by an interaction between rollers carried by the push-button and respective, aligned ramp means provided on the operators.

These and other objects, features and advantages of the present invention will become apparent from the following description when taken in connection with the accompanying drawings which show, for purposes of illustration only, a single embodiment in accordance with the present invention.

DETAILED DESCRIPTION OF THE PREFERRED EMBODIMENT

Figure 1:
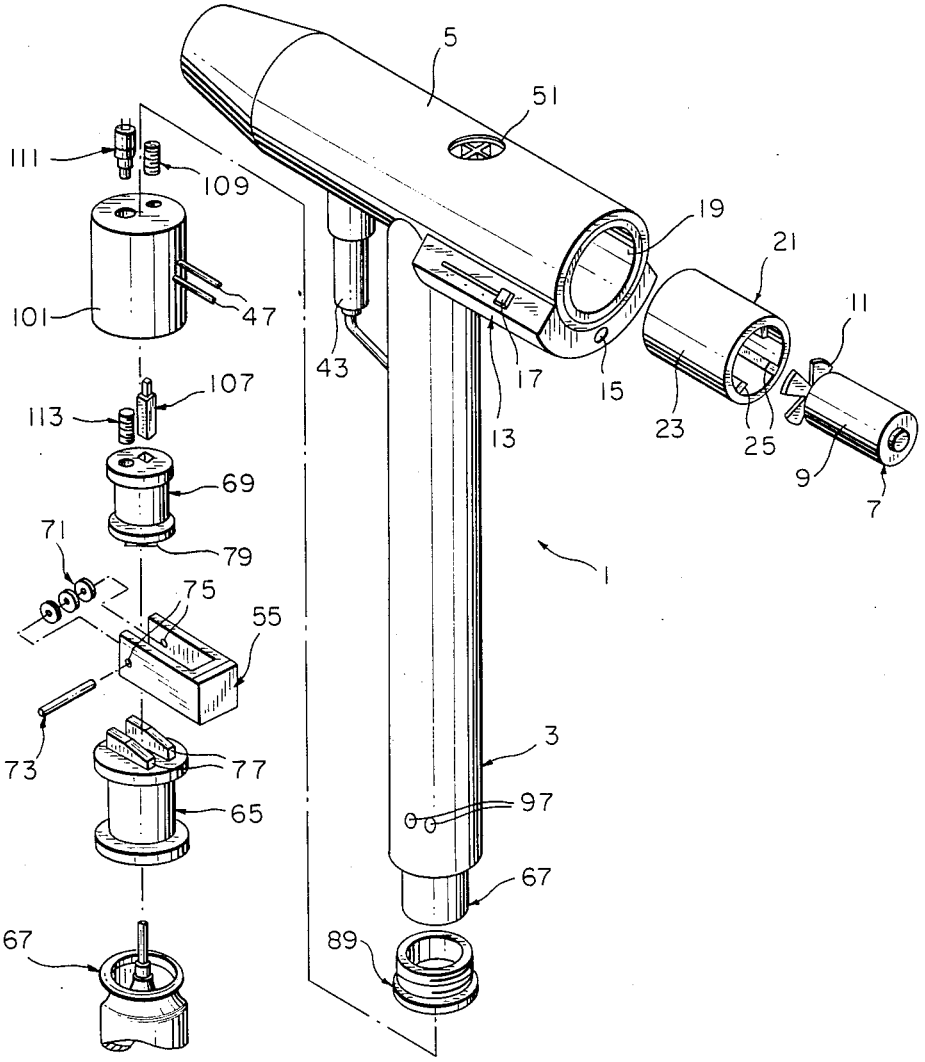
FIG. 1 is a partially exploded rear perspective view of a cordless hair dryer in accordance with a preferred embodiment of the present invention.
Figure 2:
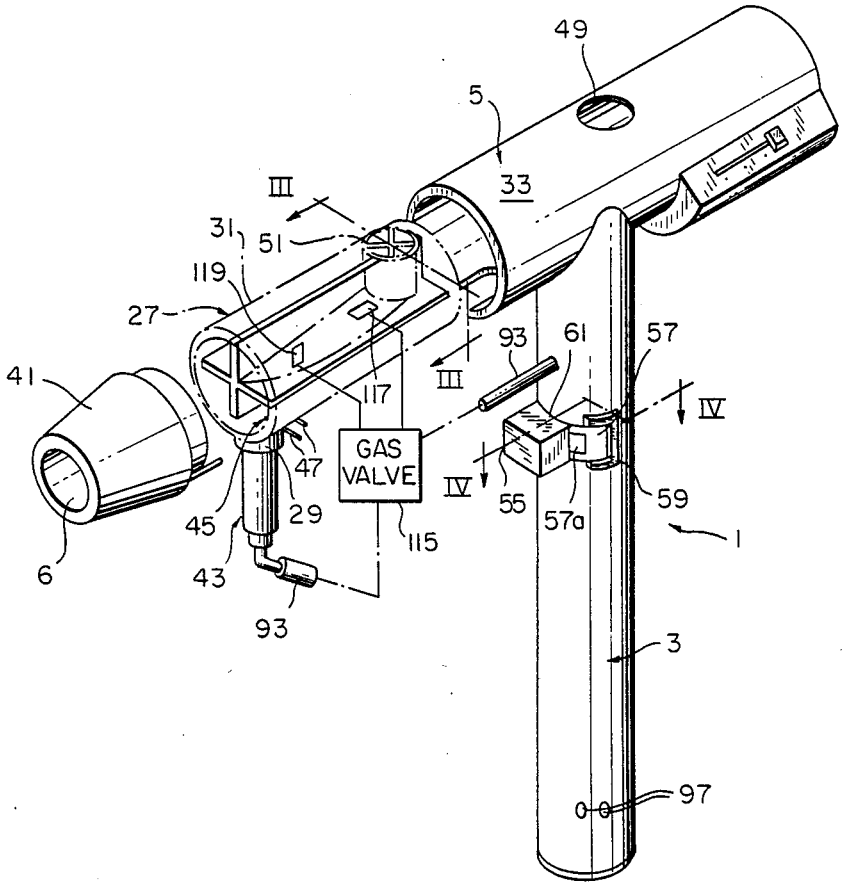
FIG. 2 is a frontal, partially exploded, perspective view of the hair dryer of FIG. 1.

In FIGS. 1 and 2, a preferred embodiment of a handheld cordless hair dryer in accordance with the present invention is illustrated and designated, generally, by the reference numeral 1. The handholdable body of the cordless hair dryer 1 is comprised of a handle body portion 3 and a nozzle body portion 5 that is mounted to a top end of the handle body portion 3.

A battery powered fan means for drawing a flow of air into the nozzle body portion 5 and for directing the flow of air along a path through the nozzle body portion 5 and out of discharge opening 6 at an outlet end of the nozzle body portion 5 is comprised of the components shown most clearly at the right-hand side of the nozzle body 5 as illustrated in FIG. 1. In particular, the battery powered fan means has a fan unit 7 formed of a fan motor 9 and a fan impeller 11 mounted to the output shaft of the motor 9. The fan unit 7 is powered by batteries, preferably rechargeable nickel-cadmium batteries, which are contained in a battery case 13, shown compactly arranged, peripherally surrounding a lower portion of the rear end of the nozzle body portion 5.

The batteries in case 13 can be recharged from a separate, conventional battery charger by plugging the charger into a recharging jack 15. In this regard, it is noted that because of the weight that would be associated with the transformer of a battery charging unit, incorporating a recharger into the body of the dryer itself would make the hair dryer 1 too heavy. To allow adjustment of the fan speed, a fan speed controller 17, in the form of a conventional multiposition, slide-type rheostat may be provided. In order to securely hold the fan unit 7 in place within the nozzle body portion, while enabling air to be drawn in from the inlet end 19 of the nozzle body portion 5, around the fan unit 7 and on toward the discharge opening 6, a fan holder 21 is used that is formed of a sleeve 23 having a plurality of axially extending support ribs 25. While the described battery powered fan means is preferred, it should be appreciated that, by enlarging the nozzle body portion 3 and displacing it rearwardly relative to the position shown, a vertically oriented fan unit may be utilized having a radially discharging impeller within the nozzle body portion 5 and with the motor disposed below it within the handle body portion.

Figure 3:
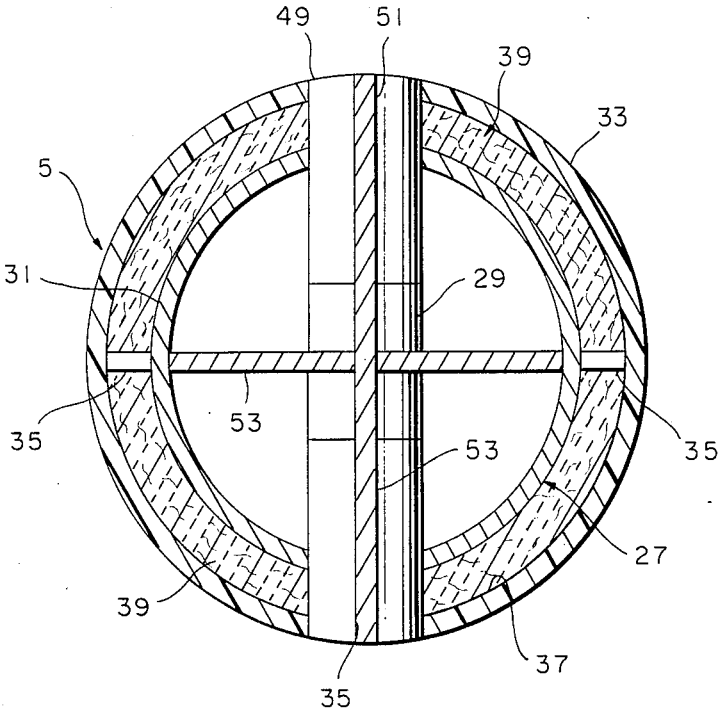
FIG. 3 is a cross-sectional view through the nozzle body portion of the preferred embodiment hair dryer of the present invention along line III—III of FIG. 2.
Figure 4:
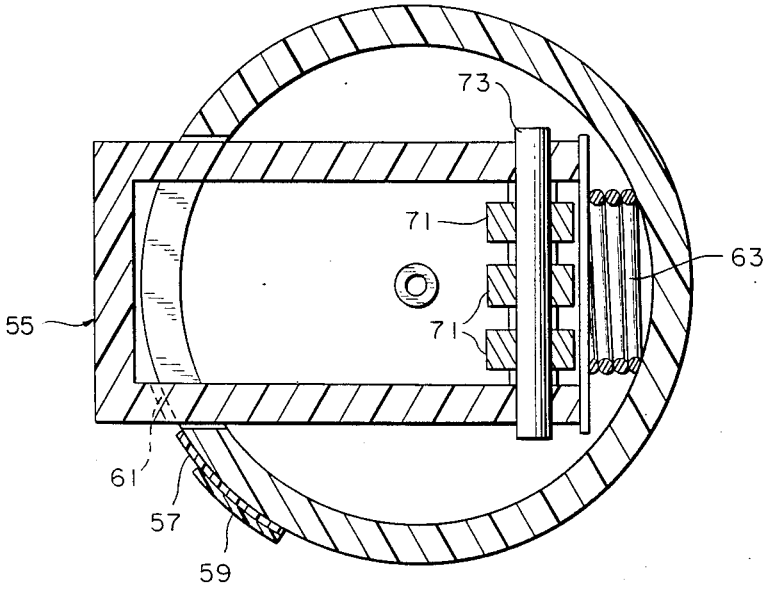
FIG. 4 is a horizontal sectional view through the nozzle body portion taken along line IV—IV of FIG. 2.

Disposed in the path of air directed through the nozzle body portion 5, from the fan unit 7 to the discharge opening 6, is a heat exchanger designated generally by the reference numeral 27 in FIGS. 2 and 3. In accordance with the illustrated preferred embodiment, the heat exchanger 27 is comprised of a heat conductive inner duct 29 formed of metal, and an outer duct 31 which is also preferably formed of heat conductive metal. Outer duct 31 can, alternatively, be formed of a nonconductive material provided with a heat conductive inner lining in order to minimize transference of heat radially outwardly from the heat exchanger 27 to the peripheral wall 33 of the nozzle body portion 5. In order to further minimize heat loss from the heat exchanger 27 to the peripheral wall 33 (both for maximizing heating efficiency and for preventing the peripheral wall 33 from becoming too hot), internal standoffs 35 are provided to support the heat exchanger 27 in space relationship to an inner surface 37 of peripheral wall 33 of the nozzle body portion 5. In this manner, an insulating space 39 is created between the heat exchanger 27 and the peripheral wall 33. Insulating space 39 may be a "dead air" space that is closed, for example, at one end by a nozzle piece 41, or it may be filled with a glass wool type insulating material 39, or it may be open to permit a small portion of the airflow from the fan unit 7 to pass therethrough.

Heat exchanger 27 serves to transfer heat to the airflow passing through it from a flame and exhaust gases produced by a gas combustion device 43. The gas combustion device may be a simple conventional gas burner unit which may draw in combustion air at an entrance end of the inner duct within which it is mounted, or it may be of a known catalytic combustion type (for example, one wherein palladium is used to combust the gas fuel, which in either case may be a gas such as butane). If a typical gas burner is utilized, then the ignition means 45 will comprise a pair of electrodes between which an arc can be produced from current supplied through ignition wires 47, in a manner to be described in greater detail later on. On the other hand, if a catalytic combustion device is utilized, the ignition means 45 will be in the form of a heating wire that is electrically heated via the ignition wires 47.

In order to maximize the amount of heat that can be extracted, from the results of the combustion process performed by device 43, and transferred to the airflow passing through the heat exchanger 27, the inner duct 29 of the heat exchanger 27 serves as a combustion tube and exhaust duct for the gas combustion device 43 and is disposed so that its intake end is located in proximity to an outlet end of the heat exchanger 27, and its opposite, discharge end is disposed in proximity to an inlet end of the heat exchanger 27, and by running it from the bottom side of the peripheral wall at the outlet end of the heat exchanger to a top side of the peripheral wall 33 at the inlet end of the heat exchanger.

The described arrangement not only maximizes the length of the combustion tube/exhaust duct from which heat may be transferred to the heating airflow through the heat exchanger 27, but also serves to ensure that the temperature of the exhaust gases is as low as possible by the time they are discharged from the nozzle body portion via the exhaust outlet 49 in peripheral wall 33. That is, since the airflow from the fan unit 7 is substantially unheated at the inlet end of the heat exchanger 27, it will not produce a reheating of exhaust gases in the discharge end of the inner duct 29 and will be best able to extract heat therefrom. Furthermore, since the temperature of the airflow will never reach that existing within the combustion zone at the intake end of the inner duct 29, the heating airflow will be able to extract heat generated by the combustion process along the full length of the heat exchanger despite the progressive increase in temperature thereof. This is in contrast to the situation that would result if the combustion device 43 were to be disposed at the intake end of the heat exchanger 27 and the exhaust gas outlet at the outlet end of the heat exchanger, because in such an arrangement the heating airflow may reach a temperature high enough to exceed that of the exhaust gases so as to undesirably start a transference of heat back from the heating airflow to the exhaust gases, reheating them so that they may be too hot when they are discharged from the dryer.

To further facilitate the extraction of heat from the flame and exhaust gases within inner duct 29, a cruciform arrangement of heat conductive metal vanes 51 may be provided extending within the inner duct 29. Similarly, a cruciform-shaped array of heat conductive vanes 53 are provided extending between the periphery of the inner duct 29 and the outer duct 31 of the heat exchanger 27. These vanes 53 not only facilitate transference of heat to the airflow passing through the heat exchanger between the inner and outer ducts 29, 31, but also serve as a means for supporting the inner duct 29 within the outer duct 31.

The manually operable actuation means by which a supply of gas fuel is delivered to the combustion device, ignition of the combustion device and operation of the fan means is activated, will now be described.

The manually operable actuation means of the present invention is designed so that by depressing a single manually shiftable switch means positioned on the handle body portion 3, a finger of a user's hand grasping the handle body portion 3 can, in a single operation, commence a flow of gas to the combustion device 43, trigger ignition of the ignition means 45, and, thereafter, turn on the fan unit 7. In the illustrated embodiment, the single manually shiftable switch means comprises a push-button 55 situated on a front side of the handle body portion 3 at a location for operation by the index finger of a user's hand. However, it should be appreciated that it could be located on the opposite side of the handle body portion 3, for operation by the thumb of a user's hand, instead, without in any way changing any other aspects of the invention.

Figure 5:
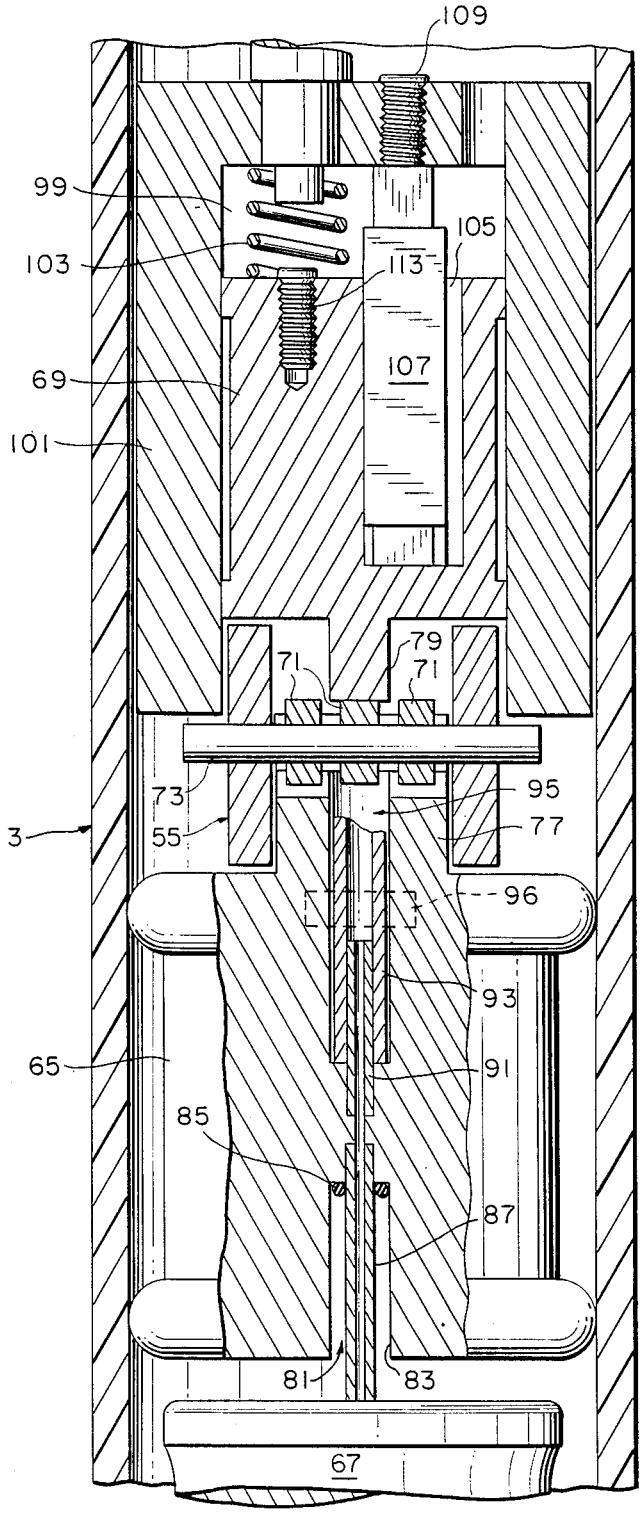
FIG. 5 is a partial, vertical sectional view through the handle body portion of the preferred embodiment of the present invention.

Furthermore, in order to prevent the push-button 55 from inadvertently being depressed from its illustrated released position of FIG. 1 into its shifted actuating position (illustrated in FIG. 5), such as by contact with objects packed with it inside a suitcase, a locking means is provided. For example, such locking means may be in the form of a plate 57, that is slidable on the peripheral surface of the handle body portion 3 under a flange plate 59, and which has projecting tab portions 57*a* which may engage in notches 61 (only one of which is represented in FIGS. 2 and 5) when the push-button 55 is in its released position and the plate 57 is slid toward the push-button from the position illustrated. Of course, it should be appreciated that any other known type of push-button locking device may be utilized. Additionally, it is noted that the push-button 55 is automatically returned into its released position by a spring biasing arrangement 63, such as that using a coil spring shown in FIG. 5.

In order for the push-button switch means 55 to commence a flow of gas to the combustion device 45, produce triggering of the ignition means 45, and activate the fan unit 7 in a sequential manner, the manually shiftable switch means formed by push-button 55 is positioned between a first reciprocable operator 65 for controlling the flow of gas from a gas supply cartridge 67 (FIGS. 1 and 5) and a second reciprocable operator 69 for controlling triggering of the ignition means 45 and activating of the fan unit 7. When the push-button 55 is depressed, the operating members 65, 69 are "wedged" apart by a cam and follower means acting between the push-button 55 and the first and second operators 65, 69.

The cam and follower means comprises a plurality of rollers 71 carried by a roller shaft 73 that is supported in pin holes 75 at opposite sides of the push-button 55. These rollers coact with ramp means in the form of a pair of ramps 77, positioned on top of the first operator 65, and a ramp 79 formed on the underside of second operator 69. Each of the ramps 77, 79 is aligned with a respective one of the rollers 71 and has an inclined surface along which the rollers 71 travel during shifting of the push-button 55. In this way, as the push-button 55 is depressed, the rollers 71 travel along the inclined surfaces in a manner causing the operators 65, 69 to be axially displaced lengthwise within the body portion 3, in opposite directions away from the push-button 55.

The first operator 65, itself, is in the form of a piston that is slidably received within the body portion 3. An axially extending through-passage 81 extends centrally from the bottom side to the top side thereof. The underside is provided with a first counterbore 83 within which an O-ring seal 85 is disposed, and with a second counterbore which seats upon the discharge nozzle of cartridge 67, when the cartridge is inserted into the open bottom end of nozzle body portion 3 and the end cap 89 reattached. Similarly, the topside of the piston forming the operator 67 is provided with a pair of counterbores between the ramps 77. Fixed in place within the innermost topside counterbore is a fuel line coupling 91. A fuel supply line 93 fits snugly upon the coupling 91 within the outer counterbore 95. Thus, when the piston 65 is forced downwardly, as a result of the interaction between the rollers 71 and ramps 77, due to the push-button 55 being depressed, the cartridge 67 is actuated to release a supply of butane gas into the fuel line 93.

Inasmuch as one form of the cartridge 67 is a commercially available product, such as that sold under the trademark "THERMACELL" by the Schwabel Corporation of Cambridge, Massachusetts, no detailed description is necessary as to the discharge manner of operation of the cartridge, itself. It is also noted that, to cover the unlikely possibility that some butane gas may be released into the handle body portion during installation of the cartridge or otherwise, vent openings 97 may be provided through the wall of the handle body portion near the lower end thereof, as shown in FIGS. 1 and 2.

Other commercially available butane cartridges may be used as the cartridge 67. For example, the cartridge 67 may be a refillable cartridge which screws into the handle 3 and which may be refilled by turning the blower into an inverted position with the handle above the nozzle. For cartridges which do not incorporate a vaporizer within the cartridge, an external vaporizer may be included in the fuel supply line 93 as indicated in broken lines at 94.

The second operator 69 is in the form of a shuttle member that is axially, slidably received within an interior space 99 of a shuttle casing 101. The ramp 79 is biased downwardly into contact with a roller 71 carried by the push-button 55 by a return spring 103 that is disposed in interior space 99, between opposed wall surfaces of the shuttle 69 and shuttle casing 101. A receiving space 105 is provided for an ignition triggering means 107 that creates a voltage which is applied to the ignition means 45 of the combustion device 43 when the shuttle 69 is displaced upwardly a sufficient degree to bring the ignition triggering means 107 into engagement within an adjustable striking member, such as a set screw 109. Set screw 109 is threaded through the top wall of the shuttle casing 101 at a location that is aligned with the triggering means 107. Thus, by threading the set screw 109 in and out of the casing 101, the point at which ignition is triggered can be adjusted. In this regard, it is noted that the triggering means can be of any conventional design, such as igniters of the type which utilize a plunger-activated piezoelectric ceramic element. For activating the fan unit 7, a fan activation switch of a type which turns on when a plunger member is pushed in and automatically turns off when pressure is no longer applied to the plunger, is mounted extending through the top wall of the shuttle casing 101 in a manner such that its actuating plunger is aligned in opposition to a fan activation adjustment set screw 113 that is adjustably threaded into the top of the shuttle member 69.

Thus, it should be apparent that, by appropriate selection of the relative slopes of the ramps 77, 79 and adjustment of the set screws 109, 113, an activation sequence can be properly coordinated so that first the supply of gas from the cartridge 67 to the combustion device 43 is commenced, and then, once the fuel has had time to reach the combustion device, ignition is triggered, followed, after a sufficient time for ignition to be achieved, by turning on of the fan unit 7. Furthermore, as soon as the push-button 55 has been released, the spring arrangement 63 causes the push-button 55 to be displaced from its activating position to its released position. As a result, operation of all components is terminated as the first and second operators 65, 69 are returned towards each other, back to their original, inactive positions, by the action of cartridge 67 and return spring 103, respectively. In this way, no harm can come if, for example, the dryer 1 is put down in an operating mode (for example, should the user have to rush to answer the telephone) and, thereafter, should forget that it has been left on.

In addition to the above safety precaution, the cordless hair dryer 1 has been provided with means to prevent potentially hazardous conditions from occurring during operation with push-button 55 depressed. In particular, safety shutoff means is provided in the form of an electrically operated gas valve 115 (FIG. 2) which is provided in the gas line 95. Gas valve 115 may be of a type that is normally open, but which is closed in response to receipt of an electrical signal. In this way, by providing a temperature sensing means on the heat exchanger 27, in the form of a switch which will produce an electrical signal when a predetermined temperature limit is exceeded, should potentially hazardous temperature levels be reached in the heat exchanger, i.e., temperatures which could result in damage to the dryer or injury to the user, a signal will be generated by the temperature sensor 117 which will cause the supply of gas fuel to the combustion device 43 to be reduced or completely shut off.

Similarly, a flame detector 119 of conventional design can be disposed in the inner duct 29 at a flame zone of the combustion device 43. Flame detector 119 serves to terminate the supply of gas to the combustion device should a flame not be produced within a predetermined time interval (such as 3 seconds) after triggering of the ignition means. In this way, a potentially explosive quantity of gas cannot accumulate in the duct between the time that the push-button 55 is pressed and the time that the user discovers that heating is not occurring and attempts to restart the device by releasing and redepressing the push-button 55. However, to permit gas to be delivered through valve 115 to the combustion device 43 when push-button 55 is initially depressed, a timing switch, activated upon depressing of the push-button 55, can be connected between the flame detector 119 and the gas valve 115 to prevent a signal from flame detector 119 being delivered to the gas valve 115 until the above-noted period of time sufficient to achieve ignition has elapsed. Of course, other equivalent control techniques, known per se, will be apparent to those of ordinary skill in the art, and may be used instead.

From the foregoing, it should be appreciated that the present invention provides a cordless hair dryer which is able to very efficiently produce a flow of high temperature air, yet effectively prevents potentially hazardous high temperature exhausts from being discharged and prevents transmission of high temperatures to the peripheral wall of the nozzle body portion itself. Furthermore, the manner in which the actuation components are constructed and arranged within the handle body portion enables a very compact construction to be achieved in a manner that is inexpensive to manufacture, while still being extremely simple to use by the press of a single finger of a hand holding the hair dryer. Furthermore, it should also be clear that the present invention is adaptable to a wide range of hair dryer designs which will not only be useful around the home, but will allow the device to be utilized where no source of A/C power is available, such as on camping trips, in automobiles, etc. The hair dryer is much safer than conventional electrical hair dryers which can be accidentally dropped in a sink full of water when in use. The present unit cannot cause electrical shock and cannot be left in an operating mode.

While we have shown and described a single embodiment in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A handheld cordless hair dryer comprising:

a handholdable body having a handle body portion and a nozzle body portion mounted to a top end of said handle body portion;

battery powered fan means for drawing a flow of air into said nozzle body portion, and for directing said flow of air along a path through said nozzle body portion and out of the nozzle body portion via an air discharge opening located at an outlet end of the nozzle body portion;

a heat exchanger disposed in said path of air directed through said nozzle body portion;

a gas combustion device disposed in said nozzle body portion in heat exchange relationship with air directed along said path via said heat exchanger;

gas fuel supply means for delivering a supply of combustible gas, from a self-contained supply of gas received in a gas container receiving space in said handle body portion, to said gas combustion device;

ignition means for igniting fuel supplied to said gas combustion device; and manually operable actuation means for activating said gas fuel supply means, ignition means and fan means;

wherein said heat exchanger is comprised of a heat conductive inner duct, an outer duct and heat conductive vanes extending along and between said inner and outer ducts in heat exchange relation to said flow of air along said path; wherein said outer duct extends axially along said nozzle body portion in spaced relationship to an inner surface of a peripheral wall of the nozzle body portion; and wherein said combustion device is mounted in one end of the inner duct and an opposite end of said inner duct opens exteriorly through said peripheral wall of the nozzle body portion whereby said inner duct comprises a combustion tube and exhaust duct for said gas combustion device.

2. A cordless hair dryer according to claim 1, wherein said combustion device is an atmospherically aspirated gas burner and said ignition means comprises a pair of electrodes and means for producing an arc therebetween.

3. A cordless hair dryer according to claim 1, wherein glass wool insulation is disposed between said outer duct of the heat exchanger and the inner surface of the peripheral wall of the nozzle body portion.

4. A cordless hair dryer according to claim 1, wherein a dead air insulation space is disposed between said outer duct of the heat exchanger and the inner surface of the peripheral wall of the nozzle body portion.

5. A cordless hair dryer according to claim 1, wherein a cooling air passage is disposed between said outer duct of the heat exchanger and the inner surface of the peripheral wall of the nozzle body portion, said cooling air passage receiving a portion of said flow of air along said path.

6. A cordless hair dryer according to claim 1, wherein said one end of the inner duct is located in proximity to an outlet end of said heat exchanger and said opposite end of the inner duct is located in proximity to an inlet end of the heat exchanger.

7. A cordless hair dryer according to claim 6, wherein said inner duct extends between a bottom wall portion of said peripheral wall at said one end of the inner duct and a top wall portion of said peripheral wall at said opposite end of the inner duct.

8. A cordless hair dryer according to claim 7, wherein a cruciform shaped heat conductive vane array extends within said inner duct.

9. A cordless hair dryer according to claim 1, wherein said combustion device is a catalytic gas burner and said ignition means comprises an electrically heated wire.

10. A cordless hair dryer according to claim 1, wherein safety shutoff means is provided for terminating flow of gas to said gas combustion device whenever temperature levels in said heat exchanger exceed a predetermined safety limit and whenever a flame is not produced by triggering of said ignition means or is extinguished thereafter.

* * * * *